United States Patent [19]

Wood

[11] Patent Number: 4,682,775

[45] Date of Patent: Jul. 28, 1987

[54] GOLF SWING TRAINING DEVICE

[76] Inventor: John M. Wood, 4849 35th St., San Diego, Calif. 92116

[21] Appl. No.: 832,065

[22] Filed: Feb. 24, 1986

[51] Int. Cl.[4] ..... A63B 69/36

[52] U.S. Cl. ..... 273/186 A; 273/186 C

[58] Field of Search ..... 273/186 A, 186 C, 194 R, 273/194 A, 194 B, 191 R

[56] References Cited

U.S. PATENT DOCUMENTS

| | | | |
|---|---|---|---|
| 3,232,623 | 2/1966 | Abrams et al. | 273/186 A |
| 4,145,054 | 3/1979 | Stewart | 273/186 A |
| 4,170,356 | 10/1979 | Banks | 273/186 A |
| 4,598,911 | 7/1986 | Lepera | 273/186 A |

*Primary Examiner*—George J. Marlo

*Attorney, Agent, or Firm*—Charles C. Logan, II

[57] ABSTRACT

A golf swing training device that is attached to the shaft of a golf club at a predetermined position below the bottom of the hand grip portion. The device has a primary clamp assembly formed from a top block member and a bottom block member whose respective bottom surface and top surface have mating semi-cylindrical shaped channels that accomodate the shaft of a golf club. There is structure for releasably clamping the two block members together. There is an elongated training arm that has its one end gripped by a secondary clamp assembly. The secondary clamp assembly is structurally connected to the top surface of the primary clamp assembly and it has the capability to have its position angularly rotated with respect to the top block member. When the training device is on the shaft of the golf club and the player is in his address position, the training arm extends rearwardly and downwardly with its free end in proximate contact with the golfers rear leg at a position between his knee and ankle. If the golfer makes a proper swing that presents the face of the golf club either perpendicular to the target or closed with respect to the target, the training arm will pass by the players leg without making contact. If the player opens the face of the club as it travels through the hitting zone, this will cause the training arm to strike the player on the leg.

5 Claims, 11 Drawing Figures

GOLF SWING TRAINING DEVICE

BACKGROUND OF THE INVENTION

The invention relates to an improved golf training aid and more particularly, to one which forms an attachment for a golf club in order to teach the golfer how to eliminate his slice shot.

In the past a variety of inventions have been developed to aid the golfer which are attached to the shaft of the golf club. Many of these have been designed for use with a putter such as the U.S. Pat. Nos. 3,190,658, 2,776,836, and 3,424,462.

U.S. Pat. No. 3,253,829 is directed to a device attached to the shaft of a golf club that includes hole alignment means and golfers head position means. Another U.S. Pat. No. 4,170,356 is directed to a device attached to a golf club for aiding a golfer to develop a proper backswing.

None of the prior art devices have been designed to allow the golfer to correct his slice swing and furthermore allow him to make adjustments to the device wwhich would allow him to hit a fade or hook shot.

It is an object of the invention to provide a novel golf swing training device that will teach a golfer how to eliminate his slice swing.

It is also an object of the invention to provide a novel golf swing device that can be easily attached and removed from the shaft of a golf club.

It is another object of the invention to provide a novel golf swing training device that is light weight and which does not materially affect the feel of a golf swing when the device is attached to the golf club.

It is an additional object of the invention to provide a novel golf swing training device that can be economically manufactured and marketed.

It is a further object of the invention to provide a novel golf swing training device that can be adjusted on the shaft of a golf club to change the angle at which the face of the golf club strikes the ball.

SUMMARY OF THE INVENTION

Applicant's golf swing training device is designed to be clamped on the shaft of a golf club at a position slightly below the hand grip portion. Th structure attaching the device to the shaft of the golf club is a primary clamp assembly having a top block member and a bottom block member whose respective bottom surface and top surface have mating semi-cylindrical shaped channels that receive the golf club shaft.

The training arm portion of the device is formed of a light material such as balsa or plastic. It is tapered and it has a length which may be in the order of approximately 20 inches to 32 inches long.

The training arm has its one end securely gripped by a secondary clamp assembly. There is structure which attaches a secondary clamp assembly to the primary clamp assembly in such a fashion that the angular position of the training arm with respect to the primary clamp assembly can be adjusted upwardly or downwardly from a position perpendicular to the golf shaft. The device can also be adjusted to the proper degree on the shaft since the primary clamping assembly can be rotated a full 360 degrees around the club shaft.

With the golf swing training device attached to the golf club, the golfer addresses the ball. The training arm will normally extend from just below the grip downwardly and rearwardly to a point where the arm will come in contact with and extend beyond a point somewhere between the knee area and lower leg area of the golfers rear leg. Since the average golfer constantly leaves the club face open at impact with the ball, they slice the ball. Applicant's invention prevents the club face from being open at impact. It squares up and if desired, closes the club face at impact automatically.

Prior to attaching applicant's novel golf swing training device to a golf club, the golfer would take his proper address position and execute his normal swing. Without the training device attached, the average golfer will slice the ball. Next the training device is attached and properly adjusted. This time the same golfer will before impact, be compelled to rotate the club shaft in a counter-clockwise direction to prevent the training arm from hitting him in the rear leg. If the golfer doesn't rotate the club shaft counter-clockwise enough or at all, the training arm will hit the golfers rear leg. As soon as the arm makes contact with the leg, the club shaft will then automatically rotate counter-clockwise from the leverage being applied from the training arm against the golfers rear leg. Therefore, either way, the club shaft is rotated counter-clockwise properly before impact. Also, the golfer knows after each swing whether he rotated the club shaft enough or not. He need not worry too much about injuring his leg because the training arm is formed of light weight material. The club face angle at impact is adjusted simply by rotating the primary clamp assembly a few degrees either direction on the shaft. After the golfer has "zeroed in" a straight ball by trial and error, he simply rotates the primary clamp assembly a few degrees clockwise to close the club face at impact which creates a draw or a hook. Likewise he may rotate the primary clamp assembly counter-clockwise to open the club face at impact. Consequently, the golfer can "dial in" whatever type of ball he wants to hit; straight, draw, hook, fade, or slice, simply by rotating the primary clamp assembly on the shaft. Because of the economical use of light weight materials, the golfer doesn't feel the golf club is now too heavy to swing in a normal manner.

DESCRIPTION OF THE PREFERRED EMBODIMENT

Applicant's novel golf swing training device will now be described by referring to FIGS. 1–11 of the drawings. The golf swing training device is generally designated numeral 20.

Figure 1:
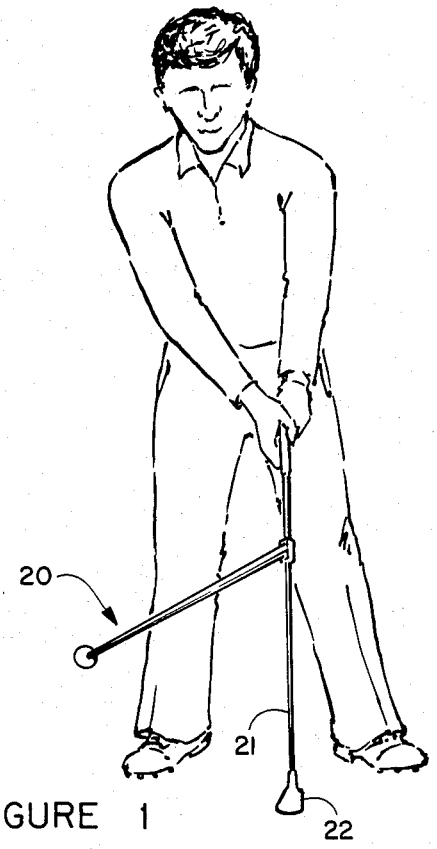
FIG. 1 is a front elevation view illustrating the novel golf swing training device in its proper relationship at the address position.
Figure 3:
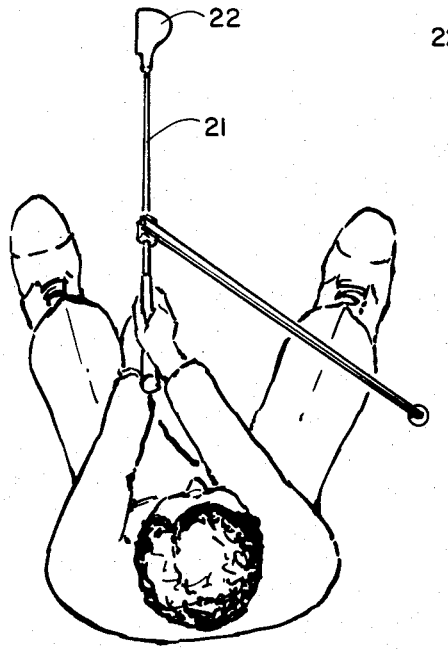
FIG. 3 is a top plan view of the golfer in FIG. 1.

In FIG. 1 the golfer has the golf swing training device 20 properly adjusted on the shaft 21 of his golf club and he is in his address position. FIG. 3 shows this position from above the golfer.

Figure 2:
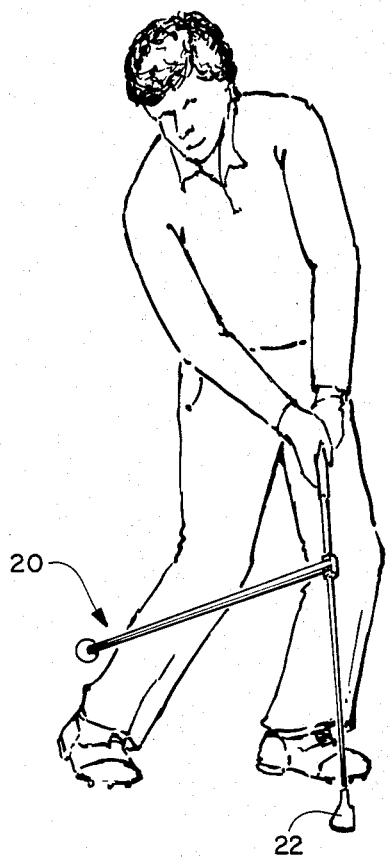
FIG. 2 is a front elevation view illustrating the novel golf swing training device in its applicable position during the golf swing.
Figure 4:
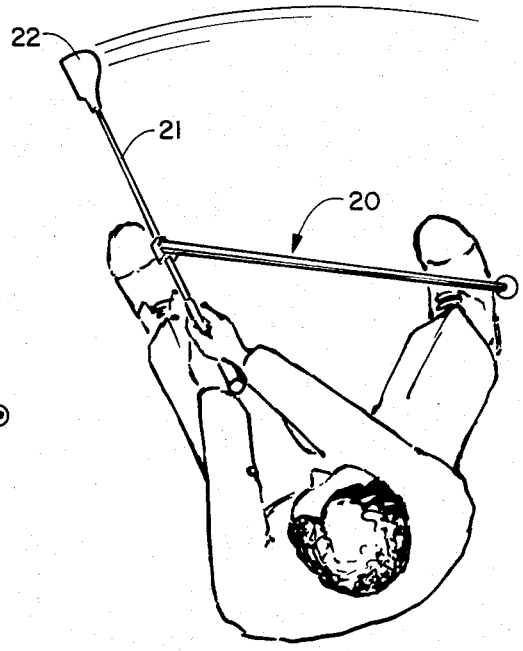
FIG. 4 is a top plan view of the golfers position in FIG. 2.
Figure 5:
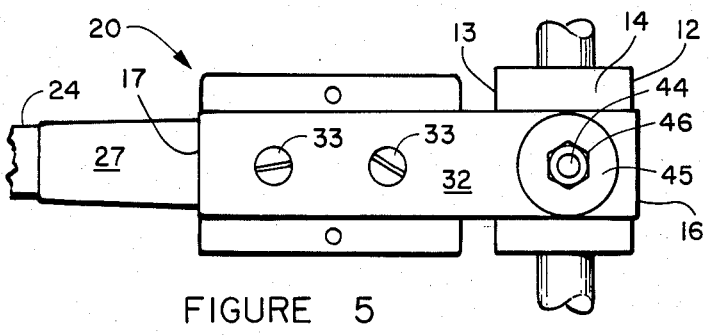
FIG. 5 is a partial top plan view of the novel golf swing training device.

In FIG. 2 the golfer has swung the head 22 of his golf club through the hitting position and the relationship of the golf swing training device 20 is illustrated. In FIG. 4, which is a top view of the golfer in FIG. 2, it will be noted that the golf swing training device when properly swung will pass by the golfers rear leg without striking it.

The structure of golf swing training device 20 is better understood by referring to FIGS. 5–9. The device has an elongated training arm 24 whose one end is captured within secondary clamp assembly 26. A fiberglass or plastic strip 27 extends along a portion of the training arm 24 and also within the secondary clamp assembly and its purpose is to provide a stiffening support to aid in preventing the training arm from breaking when an improper golf swing is made.

Secondary clamp assembly 26 is formed from a channel shaped top bracket 28 and a channel shaped bottom bracket 29. These two brackets are clamped together by sheet metal screws 30. A connecting plate 32 is attached to the top surface of secondary clamp assembly 26 by screws 33. Connecting plate 32 has a front end 16 and a rear end 17.

A main clamp assembly 35 is formed from a top block clamp member 37 and a bottom block clamp member 38. They are attached together at their rear surface by hinge assembly 40. Main clamp assembly 35 has a front 12, a rear end 13, a top surface 14, and a bottom surface 15. Top block clamp member 37 has a semi-cylindrical shaped channel 43 and bottom block clamp member 38 has a semi-cylindrical shaped channel 41. The front of main clamp assembly 35 has a quickrelease latching assembly 42. Main clamp assembly 35 is attached to connecting plate 32 by a threaded stud 44 whose bottom end is threaded into top block member 37. A pressure spring 45 and a nut 46 are used to vary the amount of pressure for attaching the two members together yet while leaving them with the ability to rotate about threaded stud 44 with respect to each other. If the training arm 24 strikes the golfers rear leg too hard, it will prevent the training arm from breaking.

Figure 6:
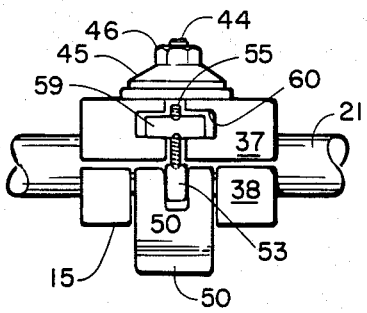
FIG. 6 is a front elevation view of the novel golf swing training device.
Figure 7:
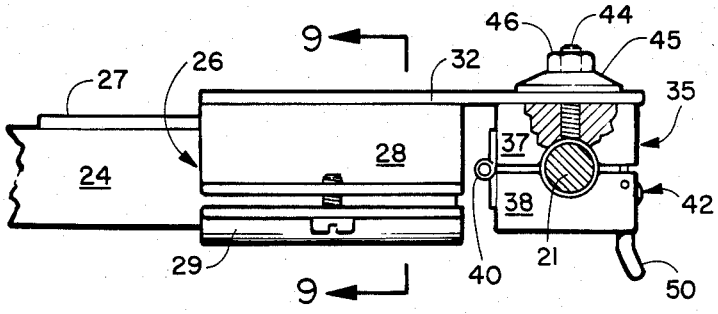
FIG. 7 is a partial side elevation view of the novel golf swing training device.
Figure 8:
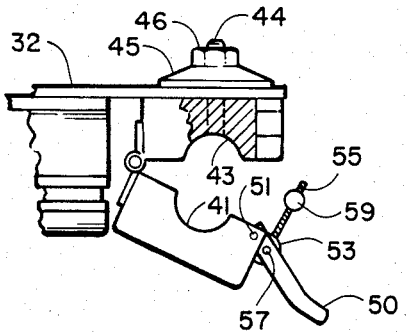
FIG. 8 is a side elevation view of the primary clamp assembly in its open position.
Figure 9:
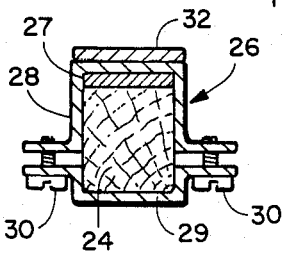
FIG. 9 is a cross sectional view taken along lines 9—9 of FIG. 7.

The quick-release latching assembly 42 is best understood by referring to FIGS. 6 and 8. A latch lever 50 has its top end pivotally secured to a pivot pin 51 passing through bottom block clamp member 38. A pivot piece 53 has a tapped hole for receiving threaded stud 55. Pivot piece 53 is mounted on pin 57. A latch pin 59 is mounted on threaded stud 55 and is captured within slot 60 of top block clamp member 37.

Figure 10:
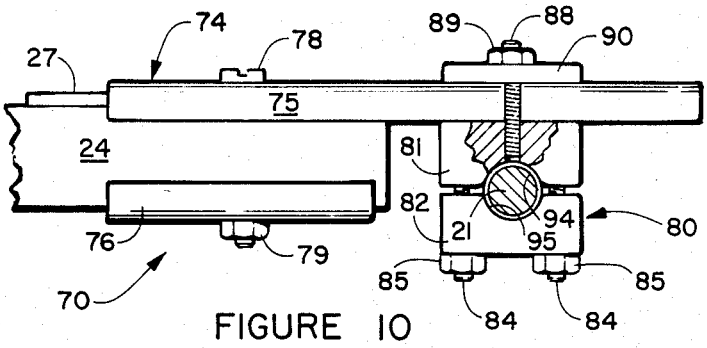
FIG. 10 is a partial side elevation view of a first alternative embodiment of the novel golf swing training device.
Figure 11:
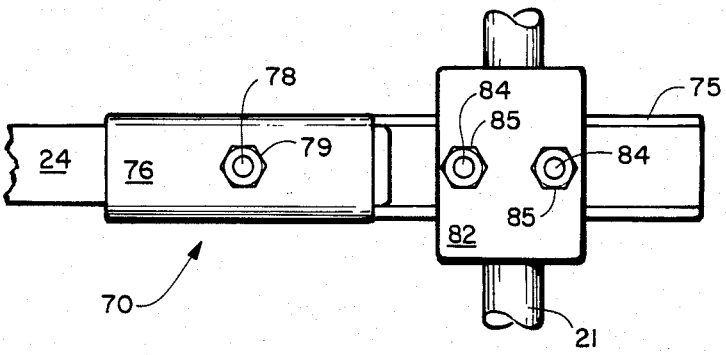
FIG. 11 is a partial bottom plan view of the alternative embodiment of the novel golf swing golf swing training device.

The first alternative golf swing training device 70 is illustrated in FIGS. 10 and 11. It has a secondary clamp assembly 74 having a channel shaped top bracket 75 and a channel shaped bottom bracket 76. The secondary clamp assembly is attached to the training arm 24 and the respective top and bottom brackets 75 and 76 by a bolt 78 passing through training arm 24 and being secured by a nut 79.

The primary clamp assembly 80 has a top block member 81 and a bottom block member 82. The top and bottom members are secured together by threaded studs 84 and nuts 85. Primary clamp assembly 80 is attached to channel shaped top bracket 75 by two threaded studs 88, two nuts 89, and a clamping plate 90. The bottom surface of block member 81 has a semi-cylindrical shaped channel 94 and the top surface of bottom block member 82 has a semi-cylindrical shaped channel 95.

By adjusting the top bracket 75 axially, the portion of the bracket 75 forward of the primary clamp assembly 80 can function as a variable counterweight.

What is claimed is:

1. A golf swing training device comprising:

a primary clamp assembly for attaching the training device to the shaft of a golf club such as an iron or a wood, said primary clamp assembly having a front end, a rear end, a top surface and a bottom surface, said primary clamp assembly having a top block member and a bottom block member, the bottom surface of said top block member and the top surface of said bottom block member having mating semi-cylindrical channels in them for receiving the shaft of a golf club;

an elongated training arm having a predetermined length at least 16 inches long, said training arm being formed of a rigid material;

a secondary clamp assembly having a channel shaped top bracket and channel shaped bottom bracket and one end of said training arm being clamped between them; and an elongated connecting plate having its rear end rigidly attached to the top surface of said channel shaped top bracket and its front end pivotally mounted to the top surface of said primary clamp assembly, means for locking said front end of said elongated connecting plate at predetermined angles so that the free end of said elongated training arm would be in close proximity to an area slightly below the right knee of a right handed golfer as he addresses the golf ball with his club face square to the proposed direction of flight of the ball, the free end of said elongated training arm being free to travel past the golfer's right knee so long as the face of his club head is square or closed, but will cause the free end of said elongated training arm to strike his leg below his knee if the club head reaches the ball with its face oriented in an open position which would cause the ball to travel in a trajectory known as a slice.

2. A golf swing training device as recited in claim 1 wherein said training arm has a tapered length.

3. A golf swing training device as recited in claim 1 further comprising a hinge assembly connecting one side of said members together and a quick release latching assembly connecting the other side of said block members together.

4. A golf swing training device as recited in claim 1 further comprising a strip stiffener material within said channel shaped top bracket that extends a predetermined distance along said training arm and in contact therewith.

5. A golf swing training device as recited in claim 1 wherein said training arm is made of balsa wood.

* * * * *